US009687054B2

(12) United States Patent
Platt et al.

(10) Patent No.: US 9,687,054 B2
(45) **Date of Patent: *Jun. 27, 2017**

(54) HANDBAGS WITH INTERCHANGEABLE COVERS AND METHODS FOR CUSTOMIZING HANDBAGS

(71) Applicant: MAGNOLIA AND VINE, INC., Hopkins, MN (US)

(72) Inventors: Jennie Platt, Sandy, UT (US); Christian J. Seegmiller, Riverton, UT (US); Corbin B. Church, Salt Lake City, UT (US)

(73) Assignee: MAGNOLIA AND VINE, INC., Minnetonka, MN (US)

( * ) Notice: Subject to any disclaimer, the term of this patent is extended or adjusted under 35 U.S.C. 154(b) by 394 days.

This patent is subject to a terminal disclaimer.

(21) Appl. No.: 14/202,807

(22) Filed: Mar. 10, 2014

(65) Prior Publication Data

US 2014/0190600 A1 Jul. 10, 2014

Related U.S. Application Data

(63) Continuation of application No. 12/776,256, filed on May 7, 2010, now Pat. No. 8,684,054, and a continuation of application No. 12/529,012, filed as application No. PCT/US2009/054896 on Aug. 25, 2009, now Pat. No. 8,684,053, application No. 14/202,807, which is a continuation-in-part of application No. 11/945,174, filed on Nov. 26, 2007, now Pat. No. 9,198,489.

(Continued)

(51) Int. Cl.
*A45C 1/02* (2006.01)
*A45C 3/08* (2006.01)
*A45C 13/26* (2006.01)

(52) U.S. Cl.
CPC ..... *A45C 1/02* (2013.01); *A45C 3/08* (2013.01); *A45C 13/26* (2013.01)

(58) Field of Classification Search
CPC ..... A45C 3/004; A45C 3/00; A45C 11/26; A45C 1/02; D06F 95/004
USPC ..... 150/100–118; 190/110, 111, 116; 383/13, 111
See application file for complete search history.

(56) References Cited

U.S. PATENT DOCUMENTS 2,809,685 A * 10/1957 Lowy ..... A45C 3/08 150/105
3,182,701 A * 5/1965 Ginsburg ..... A45C 13/08 150/105

(Continued)

*Primary Examiner* — Fenn Mathew
*Assistant Examiner* — Cynthia Collado
(74) *Attorney, Agent, or Firm* — Nikolai & Mersereau, P.A.; Thomas J. Nikolai

(57) ABSTRACT

Handbags, including soft handbags, are easily customizable by attaching or changing handbag covers of virtually any design. The handbag covers can include, at least in part, an essentially collapsible material, and are relatively small and easily stored. Accordingly, the aesthetic and design of handbags can be easily altered without requiring the purchase of different handbags of different styles. In at least one implementation of the present invention, the handbag covers essentially envelope the base handbag. Additionally, one or more implementations of the present invention include handbag covers that attach to a base handbag via a plurality of attachment forces.

17 Claims, 5 Drawing Sheets

Related U.S. Application Data

(60) Provisional application No. 61/170,883, filed on Apr. 20, 2009, provisional application No. 60/895,758, filed on Mar. 20, 2007.

(56) References Cited

U.S. PATENT DOCUMENTS

| | | | | | |
|---|---|---|---|---|---|
| 4,907,633 | A * | 3/1990 | Eckstein | A45C 3/08 | 150/105 |
| 5,725,039 | A * | 3/1998 | Macinai | A45C 3/08 | 150/104 |
| 6,394,157 | B2 * | 5/2002 | Luna | A45C 3/00 | 150/104 |
| 6,543,499 | B2 * | 4/2003 | McCreery | A45C 13/08 | 150/104 |
| 2007/0102077 | A1 * | 5/2007 | Parker-Ogden | A45C 1/06 | 150/111 |
| 2007/0163689 | A1 * | 7/2007 | Pace | A45C 3/08 | 150/105 |

* cited by examiner

HANDBAGS WITH INTERCHANGEABLE COVERS AND METHODS FOR CUSTOMIZING HANDBAGS

CROSS-REFERENCE TO RELATED APPLICATIONS

The present invention is a continuation of U.S. patent application Ser. No. 12/776,256 filed on May 7, 2010, and a continuation of U.S. patent application Ser. No. 12/529,012, filed on Aug. 27, 2009, which is a U.S. National Stage of PCT Application No. PCT/US2009/54896, filed on Aug. 25, 2009, entitled "Handbags with Interchangeable Covers and Methods for Customizing Handbags," which claims the benefit of priority to U.S. Provisional Patent Application No. 61/170,883, filed on Apr. 20, 2009, entitled "Soft Handbag with Interchangeable Handbag Covers."

The present invention is also a continuation-in-part of U.S. patent application Ser. No. 11/945,174, filed on Nov. 26, 2007, entitled "Systems and Methods for Customizing Handbags," which claims the benefit of priority to U.S. Provisional Patent Application No. 60/895,758, filed on Mar. 20, 2007, also entitled "Systems and Methods for Customizing Handbags."

The entire content of each of the above-referenced patent applications is incorporated herein by reference.

BACKGROUND OF THE INVENTION

1. The Field of the Invention

This invention relates to systems, methods, and apparatus for customizing handbags, at least in part with interchangeable handbag outer-coverings.

2. Background and Relevant Art

Handbags, despite being useful for carrying various items, are often used as an accessory item to add to or change the aesthetic of a person's ensemble. Indeed, it is often desirable to have different handbags for different destinations, outfits, and occasions. Handbags come in many different styles sufficient for a wide variety of purposes. It can be a challenge, however, for a person to purchase various different handbags sufficient to suit a number of different unique choices. For example, simply the cost of purchasing even a relatively small number of different handbags can be prohibitive. Additionally, users may be faced with a problem of how to save and/or store all the various handbags that they may have purchased. In particular, those that choose to purchase several handbags may find that the storage of the handbags require more space than anticipated or even available. Often times, this may require the user to part with a number of handbags due to a lack of storage space.

In other cases, purchasing or using several different handbags can cause other logistical issues due to the switching of handbags. For example, when a user desires to use a different handbag for whatever reason (e.g., change in environment, outfit, etc.), the user may need to spend time transferring the items from one handbag to another. Often when transferring items between handbags, items can be inadvertently left behind or even lost. This can result in various levels of inconvenience and annoyance, and can deter a user from changing handbags to gain a desired aesthetic.

Although some mechanisms for interchanging covers on a particular handbag exist, most such mechanisms tend to be ineffective and inconvenient. For example, some interchangeable handbag covers have a number of different fastener mechanisms and parts. Such fasteners typically include complex hook and loop systems, snapping elements, zipper elements, or even buckling arrangements. Such fastener systems can be particularly obvious, and can diminish the intended aesthetics, and in some cases even the function, of the resultant handbag.

Furthermore, in these or similar cases, the user will generally need to unbuckle each individual buckle element, unzip each individual zipper element, unfasten each individual snap or hook and loop element, or otherwise unfasten the given frame, and then slide the handbag cover off the base handbag to exchange a cover. One will appreciate that, while more elaborate fastening systems might hold the handbag cover in place sufficiently to prevent inadvertent removal of the cover, such fastening systems can also eliminate the convenience otherwise intended to be provided by exchangeable handbag covers. Due to these and other inconveniences, an end-user may ultimately forego changing the handbag cover with other covers due to the time and effort needed to make the change.

In other cases, conventional handbag covers only cover a portion of the base handbag. Such systems can be less than desirable because they tend not to appreciably change the overall look and feel of the handbag. Still other conventional handbag covers are too small or too large for the handbag and result in the cover coming off too easily, or not fitting the handbag at all. One will appreciate that such disparities in fitting can be particularly pronounced with flexible handbags that may vary greatly in size and shape depending upon the number of items inside the handbag.

Accordingly, there are a number of difficulties in conventional handbags, particularly where a high degree of customization may be desired, and particularly as may be applied to handbags that have relatively undefined surface features.

BRIEF SUMMARY OF THE INVENTION

Implementations of the present invention provide systems, methods, and apparatus configured to easily modify the look and feel of any particular handbag in a manner that is highly efficient. For example, at least one implementation of the present invention includes a base handbag with interchangeable outer coverings that allow the handbag to take on any number of different styles. The outer coverings, or shells, can envelope the base handbag in a highly secure manner. Despite such secure attachment, a user can still quickly and easily interchange one handbag cover with another handbag cover with little effort. Accordingly, a user can essentially obtain the benefit of having multiple different handbag styles and designs by varying only the handbag outer-coverings on a single base handbag.

For example, a customizable handbag system in accordance with an implementation of the present invention includes a base handbag having one or more attachment interfaces on at least one edge. The handbag system can further include a handbag cover configured to be secured about the base handbag and secured to the one or more attachment interfaces of the base handbag via a plurality of different attachment forces. Furthermore, the handbag system can include a plurality of fastener elements positioned on both the base handbag and the handbag cover. The plurality of fastener elements can provide a releasable attachment point for attaching the handbag cover to the base handbag.

In addition, a handbag kit configured for customizing a handbag according to one or more implementations of the present invention includes a base handbag. The handbag kit can further include a plurality of handbag covers, each comprising an essentially collapsible material. Each handbag cover can be capable of releasable attachment to the base handbag via a plurality of different attachment forces, and include a different aesthetic design. The handbag kit also can include a plurality of releasable clips attached to an upper portion of the base handbag. Additionally, the handbag kit can include a plurality of handles. Each handle can be configured for releasable attachment to the releasable clips, and can include a different aesthetic design. As such, the attachment of any of the plurality of handbag covers changes the aesthetic design of the base handbag from one handbag cover to the next.

In addition to the foregoing, a method of customizing a handbag according to an implementation of the present invention can involve positioning a handbag cover about a base handbag. The method can also involve aligning a plurality of fastener elements located on the handbag cover into a securable position relative to a plurality of fastener elements located on the base handbag. In addition, the method can involve securing one or more attachment interfaces of the handbag cover to one or more attachment interfaces of the base handbag using a plurality of different attachment forces.

Additional features and advantages of exemplary implementations of the present invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to easily modify the look and feel of any particular handbag in a manner that is highly efficient. For example, at least one implementation of the present invention includes a base handbag with interchangeable outer coverings that allow the handbag to take on any number of different styles. The outer coverings, or shells, can envelope the base handbag in a highly secure manner. Despite such secure attachment, a user can still quickly and easily interchange one handbag cover with another handbag cover with little effort. Accordingly, a user can essentially obtain the benefit of having multiple different handbag styles and designs by varying only the handbag outer-coverings on a single base handbag.

One will appreciate, therefore, that at least one implementation of the present invention provides a unique style of handbag, where a user can change the design of the handbag by simply removing the outer covering (or "shell") of a base handbag ("handbag") and replacing it with another outer covering with a different design. As a result, a user can customize the look and design of a handbag without having to transfer items from one handbag to another. In particular, a user need only change the outer-covering on the base handbag to change the aesthetic and style of a given handbag. One will appreciate that various different designs of outer-coverings can provide a user with a wide variety of design options. Furthermore, according to one or more implementations of the present invention, the outer-coverings are flattenable, and can be stored with relative ease (e.g., not taking up very much space).

As initial matter, the term "handbag" as used herein refers to any type of bag that a user can carry, hold, or at least partially support using one or more hands. Thus, the term handbag encompasses smaller sized bags, such as, for example, purses, makeup bags, beach bags, etc. The term handbag also, however, encompasses larger bags, such as, for example, suitcases, duffle bags, gym bags, or general equipment bags, etc. Thus, while the various exemplary implementations of handbags of the present invention described herein below are depicted in the Figures as smaller purse type bags, the present invention is not so limited, and encompasses a wide range of bags having various sizes, shapes, and functional purposes.

Figure 1A:
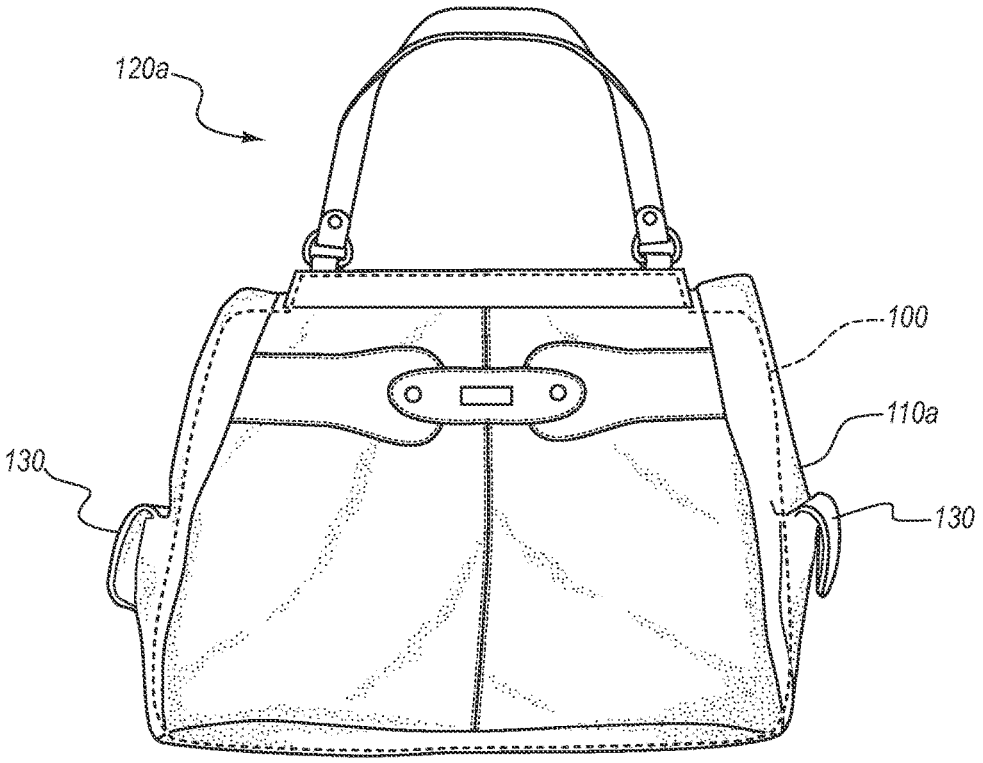
FIG. 1A illustrates a handbag in accordance with an implementation of the present invention that includes a handbag cover secured about a base handbag.
Figure 1B:
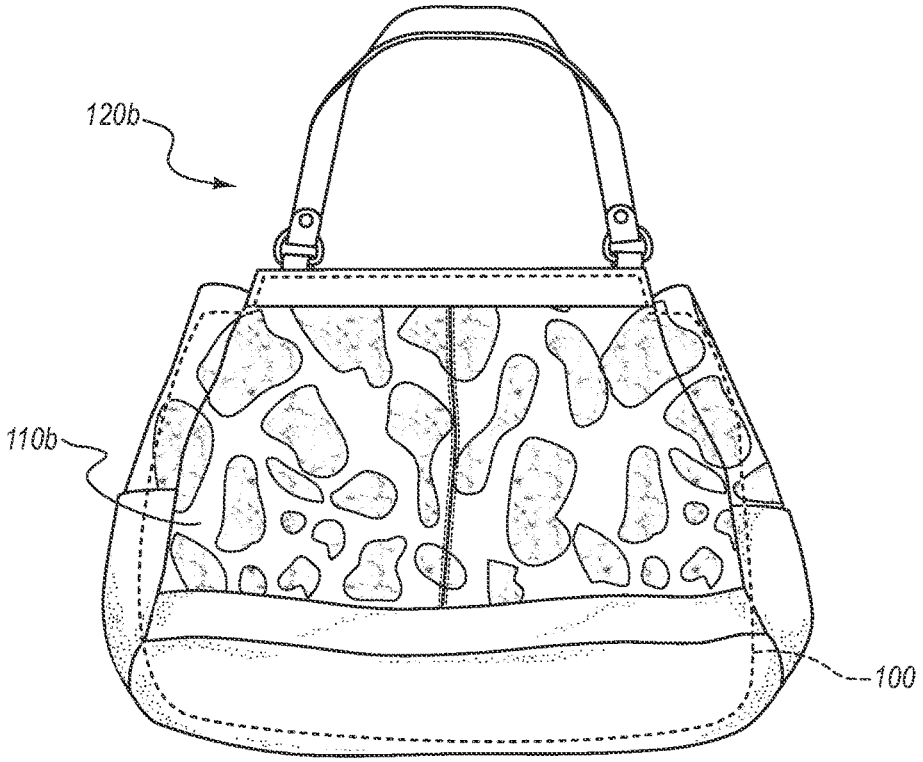
FIG. 1B illustrates a handbag in accordance with an implementation of the present invention as in FIG. 1A, albeit with a different handbag cover.

For example, FIGS. 1A-1B illustrate a base handbag 100 fashioned within different handbag covers 110*a*, 110*b* in accordance with an implementation of the present invention. In particular, FIG. 1A illustrates a mono-colored handbag cover 110*a* having a buckle design secured about a base handbag 100 resulting in handbag 120*a*. Similarly, FIG. 1B illustrates a handbag cover 110*b*, having a different aesthetic design than that of handbag 110*a* of FIG. 1A, about the same base handbag 100, resulting in handbag 120*b*. Specifically, FIG. 1B illustrates that handbag cover 110*b* has several colors (unlike cover 110*a*), but lacks the buckle design found on handbag cover 110*a*.

Thus, as shown in FIGS. 1A-1B, the handbag 120(*a, b*) can comprise a decorative handbag cover 110(*a, b*) secured about a base handbag 100. Indeed, as described in greater detail below, a user can place various items within the base handbag 100, and insert the base handbag 100 within a handbag cover 110(*a, b*) having a desired aesthetic. The user can then secure the handbag cover 110(*a, b*) to the base handbag 100 via a plurality of attachment forces. Furthermore, according to one or more implementations of the present invention, when fully assembled, the base handbag 100 and the handbag cover 110(*a, b*) can appear to be a single handbag rather than a combination of separable components. One will appreciate that such unity in appearance can provide a tremendous advantage in terms of aesthetic, and hence desirability.

As shown in FIGS. 1A-1B, the combined base handbag 100 and handbag cover 110(*a, b*) can comprise a "soft handbag" 120(*a, b*) according to an implementation of the present invention. As used herein, the term "soft handbag" refers to a compressible handbag (whether or not including the handbag cover attached thereto) that a user can substantially flatten in at least one direction. For example, assuming FIGS. 1A-1B showed the handbags 120(*a, b*) comprising the base handbag 100 and the respective handbag cover 110(*a, b*)) laid directly on a table, they would appear in a substantially flat conformation when without internal contents.

Although a soft handbag in accordance with one or more implementations of the present invention can be understood as having various side and bottom portions, each such side or portion may comprise a substantially collapsible material. The substantially collapsible material may include, for example, synthetic or natural leathers, resins (e.g., vinyl or polyester materials), or any number of cloth materials, including woven and non-woven cloths or fabrics. The collapsible nature of the material can enable the soft handbag to expand to provide space for storing or holding various items. Along similar lines, the collapsible nature of the material can enable the soft handbag to flatten, and thus, make the soft handbag storable in a relatively small space without difficulty.

While the handbags shown in FIGS. 1A-1B comprise soft handbags, in additional implementations, the handbags of the present invention may not be soft handbags. Thus, in one or more implementations, one or more of the base handbag 100 and corresponding handbag covers 110 may not be collapsible in one or more directions. For example, in one or more implementations the base handbag 100 may not be collapsible, while a corresponding handbag cover 110 may be essentially collapsible. In such implementations, the handbag 120 may have the appearance of a soft handbag, but the base handbag 100 may prevent the handbag 120 from collapsing.

One will appreciate in light of the disclosure herein that the particular handbag covers and designs illustrated in FIGS. 1A-1B are exemplary only, and that handbag covers of the present invention can nevertheless include any number of designs and configurations. For instance, in addition to varying aesthetically, the handbag covers of the present invention can also vary functionally. For example, FIG. 1A illustrates that the handbag cover 110*a* can include outer pockets 130 positioned on the sides of the handbag cover 110*a*, while FIG. 1B illustrates that the handbag cover 110*b* does not include outer pockets. Thus, one or more implementations of the present invention allow a user to not only change the aesthetic design of a handbag, but also change the function and carrying capacity of the handbag, simply by interchanging the handbag cover.

Figure 2:
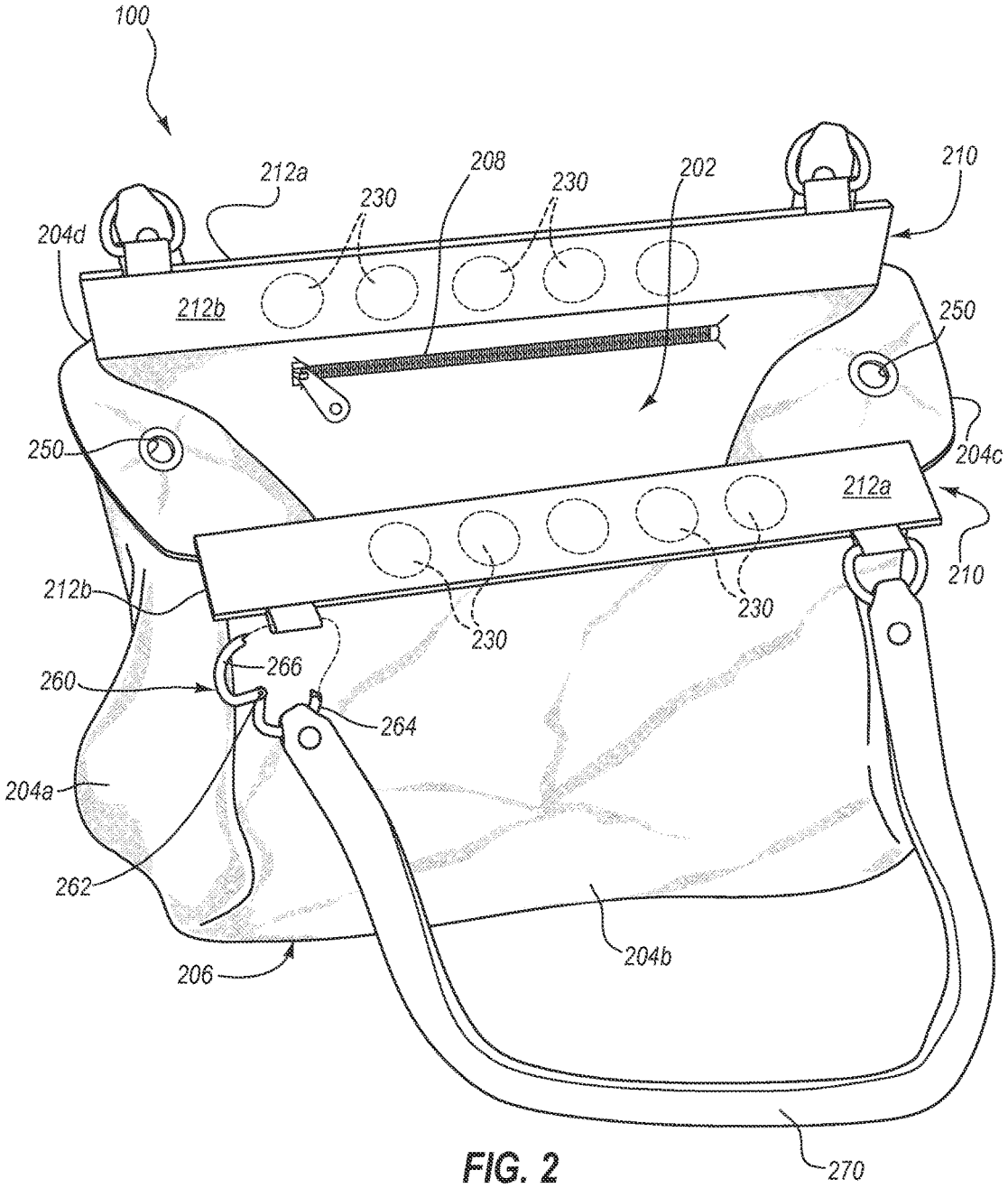
FIG. 2 illustrates a front perspective view of an exemplary base handbag such as can be used with the handbags shown in FIGS. 1A-1B.

Accordingly, implementations of the present invention each include a base handbag upon which the user can add and/or exchange handbag covers. Along these lines, FIG. 2 and the corresponding text, illustrates or describes a number of details and features of the base handbag 100 shown in FIGS. 1A-1B. Specially, FIG. 2 illustrates a front perspective view of a base handbag 100 in an opened, at least partially expanded configuration, and to which a user can secure handbag covers (e.g., to produce bags 120*a* and 120*b*). As shown in FIG. 2, the base handbag 100 can include a main pouch (or body) 202 formed by four side walls 204*a-d* and a bottom surface 206.

In addition, and as alluded to earlier, in one or more implementations at least a portion of the main pouch 202 can comprise an essentially collapsible material. The essentially collapsible material of the main pouch 202 can allow the main pouch 202 to expand or contract to hold various sizes or various numbers of items. Alternatively, at least a portion of the main pouch 202 can comprise a rigid or non collapsible material. In such implementations, the rigid material can help ensure that the main pouch 202 does not collapse upon or compress any items placed therein. In yet further implementations, the main pouch 202 can comprise a combination of essentially collapsible portions and rigid portions that provide the main pouch 202 with both the ability to flex about contents therein and provide the main pouch 202 with a distinct shape.

FIG. 2 also shows that the base handbag 100 can include various pockets, pouches, and receptacles for holding and storing various items. For instance, FIG. 2 depicts that in addition to the main pouch 202, the base handbag 100 can include a side pocket 208, which is accessible via a zipper. One will appreciate that the base handbag 100, which configured as a purse, can include any number of different pockets and configurations to enable the carriage and storage of any number of different personal items (e.g., makeup, keys, checkbooks, credit cards). In other cases, such as in a different size and shape configuration, the base handbag can be configured with duffle bag or sports bag-like features, so that it can be useful for carrying clothing, sporting equipment, etc.

However configured, and as previously mentioned, a user can customize the base handbag 100 by securing handbag covers 110(*a, b*) thereto. Along these lines the base handbag 100 can include a number of features to facilitate the attachment of handbag covers 110(*a, b*). In particular, and as described in greater detail below, the base handbag 100 can include one or more attachment interfaces that are securable to one or more attachment interfaces on a handbag cover 110(*a, b*). For example, FIG. 2 illustrates that the base handbag 100 can include attachment interfaces 210 secured to the upper edges of side walls 204*b* and 204*d*. According to some implementations of the present invention, each of the attachment interfaces 210 can have a relatively planar shape and add to the aesthetics of the handbag 120*b*.

Additionally, FIG. 2 shows that in at least one implementation of the present invention, an attachment interface 210 of the base handbag 100 can comprise first and second opposing surfaces 212*a*, 212*b*. Each of the opposing surfaces 212*a* and 212*b* can comprise one or more fastener elements 230. Alternatively, the attachment interfaces 210 can support the fastener elements 230 so that one side of each fastener element 230 is positioned against or within the outer liner of the first opposing surface 212*a* and the other side of each fastener element 230 is positioned against or within the outer liner of second opposing surface 212*b*. In any case, one will appreciate that each of the first and second opposing surfaces 212*a*, 212*b* can include one or more fastener element 230.

Additionally, the base handbag 100 can include secondary attachment interfaces 250 (or secondary base attachment interfaces 250) secured to the upper edges of side walls 204*a* and 204*b* of the main pouch 202. As shown in FIG. 2, the attachment interfaces 250 can include circular rings secured within the walls of the main pouch 202. As explained in greater detail below, the attachment interfaces 210, 250 can provide interfaces for securing handbag covers 110(*a, b*) to the base handbag 100 via a plurality of attachment forces.

In addition to interchangeable covers, one or more implementations of the present invention can also include a base handbag 100 with interchangeable handles. For example, FIG. 2 illustrates that the base handbag 100 can include releasable clips 260 for removing or replacing the handle(s) 270. In particular, FIG. 2 shows that the base handbag 100 can include one or more releasable handle clips 260 (e.g., carabineer-style), which comprise a general ring body formed by a first and second portions 264, 266 connected by a flexible hinge 262. As a result, a user can open the releasable clip 260 to remove or change a given handle 270. Of course, other types of release mechanisms may be used in accordance with the principles of the present invention.

In any event, one will appreciate that the ability to change a given handle 270 or set of handles from base handbag 100 can provide additional configurability and flexibility to the handbags described herein. In particular, the ability to interchange handles 270 allows the base handbag 100 to include different sizes and colors of handles 270, and thus a different level of customization beyond just customizing the handbag covers 110(*a, b*). Similar to the handbag covers 110(*a, b*), one or more implementations of the present invention can comprise various different styles of handles 270 to provide a user with a wide variety of design options.

Figure 3:
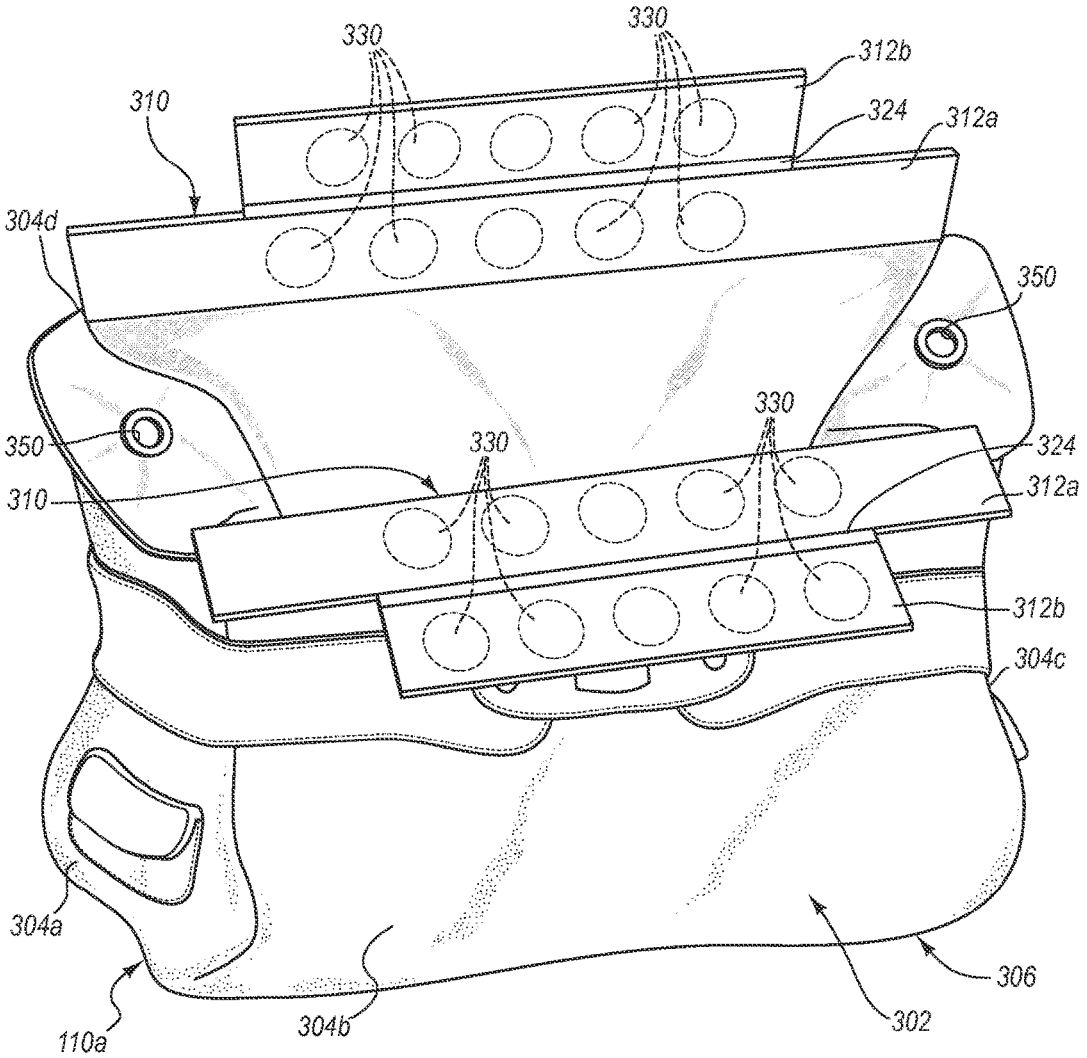
FIG. 3 illustrates a front perspective view of the handbag cover of FIG. 1A, which is securable about or to the base handbag of FIG. 2 in accordance with an implementation of the present invention.

FIG. 3 and the corresponding text, illustrates or describes a number of details and features of the handbag cover 110*a* shown in FIG. 1A. For example, FIG. 3 illustrates that the handbag cover 110*a* can include a main pouch 302 or body formed by four side walls 304*a-d* and a bottom surface 306. The main pouch 302 can have a size and configuration to allow it to receive and cover the base handbag 100, as described in greater detail below. As mentioned above, the main pouch 302 can comprise, at least in part, an essentially collapsible material. The essentially collapsible material forming the main pouch 302 can allow the main pouch 302 to expand or contract in accordance with a base handbag 100 to which it is secured, and/or to be substantially flattened, such as for storage.

As shown in FIG. 3, the handbag cover 110*a* can include one or more attachment interfaces for use in securing the handbag cover 110*a* to a base handbag 100, as described in greater detail below. In particular, as shown in FIG. 3, the handbag cover 110*a* can include attachment interfaces 310 secured to the upper edges of the side walls 304*b* and 304*d* of the main pouch 302. Each of the attachment interfaces 310 can include one or more fastener elements 330, which are securable to the fastener elements 230 of the base handbag 100. Additionally, FIG. 3 illustrates that each attachment interface 310 of the handbag cover 110*a* can include a lower portion 312*a* and an upper portion 312*b* connected by a crease 324. As shown in FIG. 3, each of the upper and lower portions 312*a* and 312*b* can comprise one or more fastener elements 330. As explained in greater detail below, a user can fold the attachment interfaces 310 of the handbag cover 110*a* about the attachment interfaces 210 of the base handbag 100 to secure the handbag cover 110*a* to the base handbag 100.

Additionally, the handbag cover 110*a* can include secondary attachment interfaces 350 (or secondary cover attachment interfaces) secured to the upper edges of side walls 304*a* and 304*b* of the main pouch 302 that correspond with the secondary base attachment interfaces 250 shown in FIG. 2. As shown in FIG. 3, the attachment interfaces 350 can include circular rings secured within the walls of the main pouch 302. As described in greater detail below, the attachment interfaces 350 can provide a secure attachment site for releasable rings, which can both secure the handbag cover 110*a* to the base handbag 100, and secure straps to the handbag.

Figure 4:
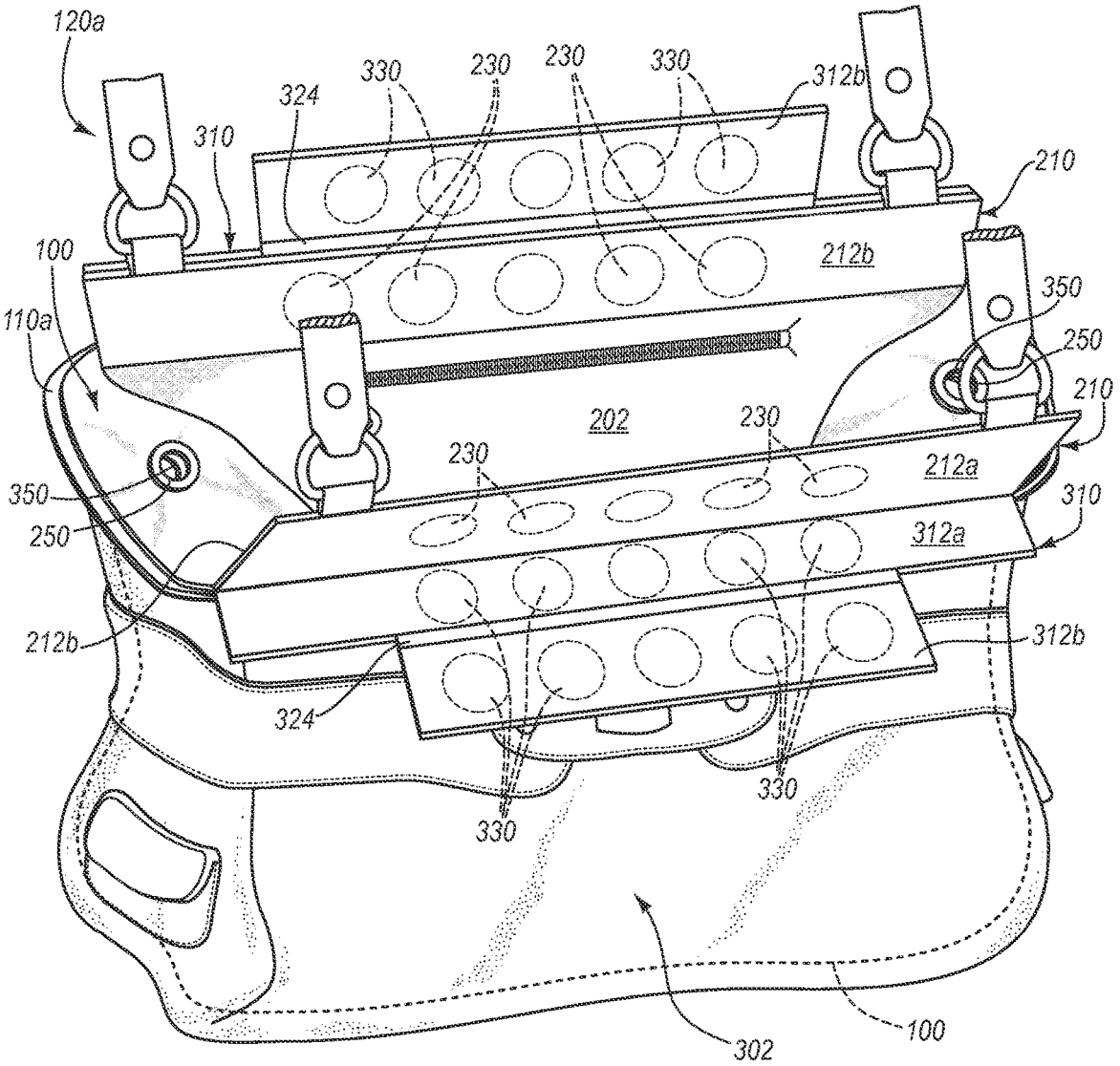
FIG. 4 illustrates a front perspective view of the base handbag of FIG. 2 positioned within, but unsecured to the handbag cover of FIG. 3.

As mentioned previously, the handbag cover 110*a* can include any number of different styles or designs to allow a user to customize a base handbag 100. For example, FIG. 4 illustrates a front perspective view of a partially assembled handbag 120*a*. As shown in FIG. 4, the handbag 120*a* includes a base handbag 100 about which a handbag cover 110*a* is partially secured. In particular, the base handbag 100 is positioned within the handbag cover 110. As described in greater detail below, a user can secure the attachment interfaces 210 of the base handbag 100 to the corresponding attachment interfaces 310 of a handbag cover 110*a* using a plurality of attachment forces to fully secure the handbag cover 110*a* to the base handbag 100.

As mentioned above and as shown in FIG. 4, the attachment interfaces 210 of the base handbag 100 can each include one or more fastener elements 230. Similarly, the attachment interfaces 310 of the handbag cover 110*a* can also each include one or more fastener elements 330. In at least one implementation of the present invention, the fastener elements 230 comprise a set of one or more corresponding elements, such as iron, nickel, or cobalt (or the like) that have been made into permanent magnets, while the fastener elements 330 comprise a set of one or more corresponding elements made from the same (or similar) materials that have not been permanently magnetized, but are attracted to the permanent magnets. In another implementation of the present invention, the fastener elements 230 can comprise a set of one or more corresponding elements made from materials that have not been permanently magnetized, but are attracted to the permanent magnets, while fastener elements 330 comprise permanent magnets.

Thus, the fastener elements 230 of the base handbag 100 can be securable to the corresponding fastener elements 330 of the handbag cover 110*a*. One will appreciate in light of the disclosure herein that whether any particular fastener elements 230, 330 comprise permanent magnetic, or elements attracted to the permanent magnets, is not required. Indeed, a manufacturer can even mix the various fastener elements 230 of the base handbag 100 so that only some of the fastener elements 230 are permanent magnets, while the other fastener elements 230 are not (e.g., VELCRO, or snap fasteners). Along similar lines, a manufacturer can mix the various fastener elements 330 of the handbag cover 110*a* between permanent magnets and elements attracted to permanent magnets to correspond to the fastener elements 230 of the base handbag 100, or vice versa.

In any case, a manufacturer can affix the fastener elements 230, 330 to (generally inside) an attachment interface 210, 310 so that the fastener elements 230, 330 are effectively flush with (or within) the surface of the attachment interfaces 210, 310. For example, each of the attachment interfaces 210, 310 can include one or more substrates (not shown) having fastener elements 230, 330 affixed thereon or therein. An outer liner (i.e., the outside, illustrated surface of the attachment interfaces 210, 310) can then cover the substrate and the fastener elements 230, 330. As understood more fully herein, in one or more implementations of the present invention, this means that the fastener elements 230, 330 will be relatively imperceptible to the ordinary viewer as distinguishable from the attachment interfaces 210, 310 themselves. Additionally, this configuration of the fastener elements 230, 330 can help ensure that the attachment interfaces 210, 310 are securable to each other with a great deal of security when placed in the appropriate position, as described more fully below.

While FIG. 4 illustrates the fastener elements 230, 330 as discrete elements, one will appreciate that this is not necessarily required. For example, the fastener elements 230, 330 may comprise a single fastener element, which may or may not span the entire length of the corresponding attachment interface 210, 310. In any case, one will appreciate in light of the disclosure herein in one or more implementations of the present invention, the number or type of fasteners elements 230 of the base handbag 100 can correspond with the number or type of fastener elements 330 used in the corresponding handbag cover 110*a*. Furthermore, a manufacturer can base the number, size, and dimension of the fastener elements 230, 330 used in the attachment interfaces 210, 310 on any number of different factors, including overall holding/attraction strength, shape of the base handbag 100 and/or handbag cover 110*a*, or other aesthetic or functional concerns.

For example, FIG. 4 illustrates that, in order to increase the overall holding/attraction strength between the base handbag 100 and the handbag cover 110*a*, the handbag 120*a* can include a greater number of fastener elements 330 than fastener elements 230. In particular, in one or more implementations of the present invention, a user can secure a fastener element 330 of the handbag cover 110*a* to each side of one or more fastener elements 230 of the base handbag 100. Thus, for each of the one or more of the fastener elements 230 of the attachment interfaces 210 of the base handbag 100, the attachment interfaces 310 can have two corresponding fastener elements 330 on opposing sides. As explained in greater detail below, the additional fastener elements 330 included in each attachment interface 310 of the handbag cover 110*a* can provide additional strength to the bond between the base handbag 100 and handbag cover 110*a* when assembled together.

Furthermore, while the fastener elements 230, 330 of the handbag 120*a* depicted in FIG. 4 are hidden from view, one will appreciate that the handbag 120*a* can include fastener elements 230, 330, magnetic or otherwise, that are visible. For example, the handbag 110*a* can include fastener elements 230, 330 on the outside, viewable surfaces of base handbag 100 and/or handbag cover 110*a* sides. In one or more implementations of the present invention, however, a manufacturer may prefer to arrange and/or configure the fastener elements 230, 330 so that they are hidden from view, or otherwise obscured, especially when the attachment interfaces 310 of the handbag cover 110*a* are connected to attachment interfaces 210 of the base handbag 100.

In addition, one will appreciate that magnetic elements are only one type of fastener element which the handbags of the present invention may include. For example, handbags according to one or more implementations of the present invention can also or alternatively use other forms of fastening elements that include, but are not limited to, hook and loop elements, snap elements, and/or types of friction-based fasteners. Depending on the design and function of the given fastener elements, the handbag 120*a* can include any number or arrangement of such fastener elements on the base handbag 100 and handbag cover 110*a* as needed to ensure an appropriate attraction there between.

For instance, a handbag according to one or more implementations of the present invention may include an equal number of corresponding snap-based fastener elements on the attachment interfaces 210 of base handbag 100 and the attachment interfaces 310 of the handbag cover 110*a*. By contrast, and as with magnetic-based fastener elements 230, 330, the handbag 120*a* may additionally or alternatively include any number or arrangements of hook and loop-based fastener elements on the attachment interfaces 210 of the base handbag 100 and attachment interfaces 310 of the handbag cover 120*a*. Furthermore, the handbag 120*a* can include any combination of magnets, snaps, and hook and loop fastener elements, as needed to create an appropriate bond between the handbag cover 110*a* and the base handbag 100.

Of course, one will appreciate that using relatively strong but thin magnetic fastener elements 230, 330 can provide a number of different advantages. At least one such advantage is the size aspect of such exemplary magnetic fastener elements 230, 330. The thin profile of the magnetic fastener elements 230, 330 can provide each of the base handbag 100 and the handbag cover 110*a* with a sleek, planar attachment interface that is aesthetically pleasing on its own. At least another advantage of using relatively strong or relatively large numbers of magnets is that such can provide sufficient attractive force through the given outer surface of the base handbag 100 in order to enable a strong attachment to the handbag cover 110*a*, as discussed more fully hereinafter.

As mentioned previously, a user can secure the handbag cover 110*a* to or about the base handbag 100 via a plurality of attachment forces using at least the attachment interfaces 210, 310. For example, as explained in greater detail hereafter, according to one or more implementations of the present invention, a user can position a handbag cover 100*a* about a base handbag 100. The user can then align the fastener elements 330 of the handbag cover 110*a* into a securable position relative to the fastener elements 230 of the base handbag 100 to create a magnetic attachment force between the handbag cover 110*a* and the base handbag 100. Thus, the user can secure the one or more attachment interfaces 310 of the handbag cover 110*a* to the one or more attachment interfaces 210 of the base handbag 100. For instance, the user can fold each attachment interface 310 of the handbag cover 110*a* along crease 324, and around a corresponding attachment interface 210 of the base handbag 100. This can create a gravitational attachment force (supported at least partly by crease 324) between the handbag cover 110*a* and the base handbag 100.

Figure 5:
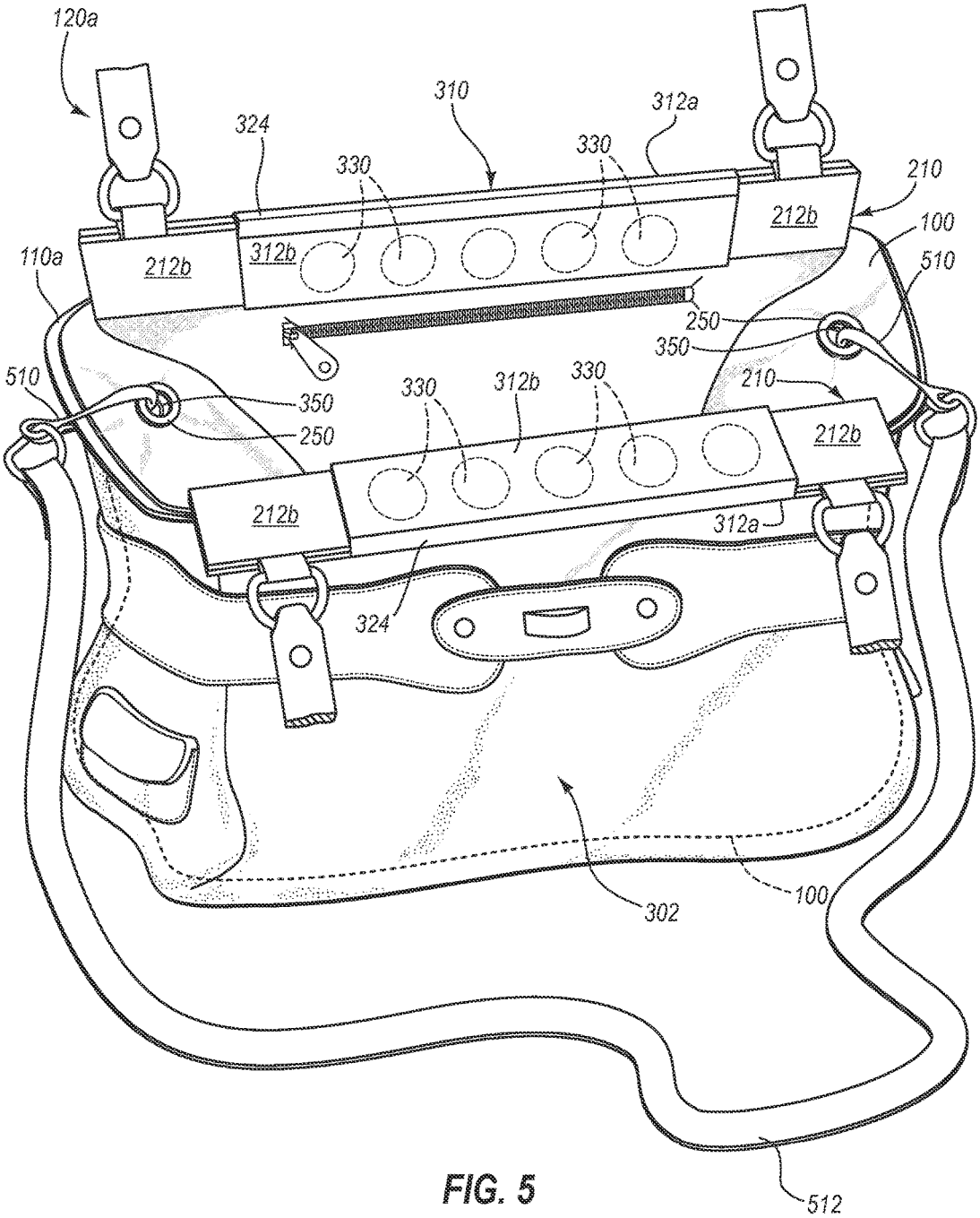
FIG. 5 illustrates a front perspective view of the handbag cover of FIG. 3 positioned about and secured to the base handbag of FIG. 2 via a plurality of attachment forces.

FIG. 5 illustrates additional details according to at least one implementation of the function and use of the attachment interfaces 210, 310. In particular, in order to illustrate the features and interactions between the attachment interfaces 210, 310, FIG. 5 illustrates each of the attachment interface 310 of the handbag cover 110*a* fully secured or attached to an attachment interface 210 of the base handbag 100. This is in contrast to FIG. 4, which shows the attachment interfaces 310 of the handbag cover 110*a* unfolded and detached from the attachment interfaces 210 of the base handbag 100.

Thus, referring to both FIGS. 4 and 5, each of the bottom portions 312*a* of the attachment interfaces 310 of the handbag cover 110*a* can mate with a first opposing surface 212*a* of an attachment interface 210 of the base handbag 100. Additionally, FIG. 5 shows that after a user folds the attachment interfaces 310 about the creases 324, each of the upper portions 312*b* of the attachment interfaces 310 of the handbag cover 110*a* can mate with the second opposing surface 212*b* of the attachment interfaces 210 of the base handbag 100. Therefore, in order to secure the attachment interfaces 310 of the handbag cover 110*a* to the attachment interfaces 210 of the base handbag 100, a user can first align the fastener elements 330 in the lower portions 312*a* of the attachment interfaces 310 with the fastener elements 230 of the first surfaces 212*a* of the attachment interfaces 210. One will appreciate that by aligning the fastener elements 230, 330 with each other, a magnetic attachment force is created between the base handbag 100 and the handbag cover 110*a*.

FIG. 5 shows that a user can then fold the upper portions 312*b* of attachment interfaces 310 along creases 324 and about an upper edge of the attachment interfaces 210 (which are also the upper edges of base handbag 100). After which, the user can align the fastener elements 330 in the upper portions 312*b* with the fastener elements 230 of the second opposing surfaces 212*b*. One will appreciate that this can thereby create an additional magnetic attachment force between the base handbag 100 and the handbag cover 110*a*. In at least one implementation, folding the upper portions 312*b* about the creases 324 also allows the attachment interfaces 310 to essentially envelope the attachment interfaces 210, thereby creating a gravitational attachment force between the base handbag 100 and the handbag cover 110*a*.

Thus, in the case of using magnets as fastener elements 230, 330, the configurations of the attachment interfaces in FIG. 5 illustrate that both gravitational (along crease 324) and magnetic (e.g., elements 330 against 230) attachment forces can join the base handbag 100 to the handbag cover 110*a*. The attachment forces, in turn, can only be broken when a user applies enough force to unfold attachment interfaces 310 from attachment interfaces 210, thereby breaking the combination of bonds (gravitational and/or magnetic, or otherwise) of the attachment forces.

One will appreciate the particular configuration of the attachment interfaces 210, 310 illustrated in FIGS. 4-5 is only an exemplary configuration of attachment interfaces that can secure a handbag cover 110*a* to a base handbag 100 via a plurality of attachment forces. For example, according to another implementation of the present invention, the attachment interfaces 210 of the base handbag 100 can fold about the attachment interfaces 310 of the handbag cover 100. In yet further implementations of the present invention, the attachment interfaces 210, 310 can span the entire upper edges of the base handbag 100 and the handbag cover 110*a*, or alternatively only span a single edge.

In addition to gravitational and magnetic attachments forces, one or more implementations of the present invention can create mechanical attachment forces between the handbag cover 110*a* and the base handbag 100. For example, as mentioned previously, one or more of the fastener elements 230, 330 can comprise hook and loop elements, snap elements, buckle elements, or other fasteners that create a mechanical attachment force. One will appreciate that mechanical attachment forces can increase or vary the bond between the base handbag 100 and a handbag cover 110*a*.

For example, in one or more implementations, the handbag cover 110 can include one or more elastics extending between the attachment interfaces 310, or otherwise around at least a portion of the upper edge of the handbag cover 110. The elastics can be held within the handbag cover 110, and thus, hidden from view. The elastics can create an additional or alternative attachment force between the handbag cover 110 and the base handbag 100. In particular, the elastics can secure the upper edge of the handbag cover 110 about the base handbag 100 via a compressive mechanical attachment force. One will appreciate in one or more implementations including elastics, the attachment interfaces 310 of the handbag covers 110*a* may not include upper portions 312*b*. In such cases, the plurality of attachment forces securing the handbag cover 110 to the base handbag 100 can include a magnetic force created by the fastener elements 230, 330 and a mechanical force created by the elastics.

In at least one implementation of the present invention, a customizable handbag can include mechanical attachment forces created by releasable rings in addition to, or as an alternative to, the gravitational and magnetic attachment forces described hereinbefore. For example, FIG. 5 illustrates that a user can secure releasable rings 510 through the attachment interfaces 250 of the base handbag 100 and the attachment interfaces 350 of the handbag cover 110*a*. The releasable rings 510 can provide a mechanical attachment force for securing the handbag cover 110*a* to the base handbag 100. Indeed, the attachment force provided by securing releasable rings 510 into both sets of attachment interfaces 250, 350 can combine with the attachment forces provided by attachment interfaces 210, 310, to add still further stability to the attachment of the handbag base 100 to the corresponding handbag cover 110*a*.

Additionally as shown in FIG. 5, the releasable rings 510 can provide a secure attachment point for attaching one or more interchangeable shoulder straps 512 to the handbag 120*b*. One will appreciate that the ability to interchange a given shoulder strap 512 or set of shoulder straps 512 from handbag 120*a* can provide additional configurability and flexibility to the handbags described herein. In particular, the ability to interchange shoulder straps 512 allows the base handbag 100 to include shoulder straps of different sizes and colors, and thus a different level of customization beyond just customizing the bag cover(s) 110(*a, b*) and handles 270.

In any event, one will appreciate that the attachment interfaces and attachment forces used to secure the handbag cover 110*a* to the base handbag 100 can provide a sufficiently strong attachment so as to prevent the handbag cover 100*a* from inadvertently releasing from the base handbag 100. Furthermore, the attachment interfaces can provide a secure bond between the base handbag 100 and the handbag cover 100*a*, while reducing any visible indications that the handbag 120 includes a base handbag 100 with a removable cover 110. For example, as shown in FIGS. 1A and 1B because the attachment interfaces 310 fold about the attachment interfaces 210 into the main pouch 202 of the base handbag 100, any connection between a handbag cover 110 and a base handbag 100 is hidden from view. The ability of one or more handbags of the present invention to provide a secure attachment between a base handbag 100 and a handbag cover 110, while also hiding or significantly reducing the visibility of any fasteners or connection between a base handbag 100 and a handbag cover 110 can provide significant aesthetic appeal.

In addition to the foregoing, a handbag kit in accordance with an implementation of the present invention can comprise at least one base handbag 100. The handbag kit also comprises a plurality of attachable/detachable handbag covers 110 of a plurality of different styles and/or colors. In additional or alternative implementations, the handbag kit further comprises a plurality of detachable and re-attachable handles 270 of a plurality of different styles that correspond to the styles of the plurality of handbag covers 110. Along these lines, the handbag kit can further comprise a plurality of interchangeable, releasable clips attachable to an upper portion of the base handbag 100. In at least one implementation of the present invention, the base handbag 100 and handbag covers 110 include one or more attachment interfaces 210, 310 that are securable together using a plurality of attachment forces. For example, two or more of magnetic, gravitational, frictional, and mechanical attachment force can secure the attachment interfaces 310 of the handbag cover 110 to the attachment interfaces 210 of the base handbag 100.

Accordingly, one will appreciate that implementations of the present invention provide a number of advantages for attaching and detaching various handbag covers to a base handbag with simple and efficient mechanisms that are physically sound and secure. One will appreciate that the features described herein can be modified in a number of different ways. For example, as previously described, the manufacturer may use any number or type of fastener elements 230, 330 that may be essentially flush or planar with the attachment interfaces 210, 310 or otherwise imperceptible during attachment. Still further, in accordance with implementations of the present invention, the manufacturer may choose to have visibly perceptible fastener elements 230, 330, which may, for example, provide further decorative elements. Accordingly, implementations of the present invention provide a number of mechanisms that can be used to efficiently, effectively, and securely interchange covers of a handbag in a wide variety of ways using one or more attachment forces.

The present invention may be embodied in other specific forms without departing from its spirit or essential characteristics. The described embodiments are to be considered in all respects only as illustrative and not restrictive. For example, one will appreciate that implementations of the present invention can also or alternatively be configured for use with the principles described herein as backpacks, duffle bags, or sports equipment bags with interchangeable covers. One will appreciate that such sport or duffle bags can include such bags as gym bags, bowling ball bags, soccer bags, golf bags, or the like configured as described herein. The scope of the invention is, therefore, indicated by the appended claims rather than by the foregoing description. All changes that come within the meaning and range of equivalency of the claims are to be embraced within their scope.

We claim:

1. A customizable handbag system comprising:

a base handbag including a first attachment interface along a first edge and a second attachment interface along a second edge, each of the first and second attachment interfaces comprising an interior surface, an exterior surface, and one or more fastener elements; and a handbag cover configured to be positioned about the base handbag, and to conceal at least a portion of the base handbag, the handbag cover comprising first and second handbag cover attachment interfaces, each of the first and second handbag cover attachment interfaces comprising an upper portion and a lower portion connected by a crease, each of the upper portion and lower portion comprising one or more fastener elements;

wherein the first handbag cover attachment interface is selectably foldable along the crease to sandwich the first attachment interface of the base handbag between the upper and lower portions of the first handbag cover attachment interface and wherein the second handbag cover attachment interface is selectably foldable along the crease to sandwich the second attachment interface of the base handbag between the upper and lower portions of the second handbag cover attachment interface;

wherein the one or more upper fastener elements of the first and second handbag cover attachment interfaces attach respectively to the one or more fasteners elements in the corresponding first and second attachment interfaces of the base handbag, thereby securing each of the first and second handbag cover attachment interfaces to the exterior and interior surfaces of the corresponding first or second attachment interfaces of the base handbag.

2. The system as recited in claim 1, wherein one or both of the first and second first attachment interfaces of the handbag cover comprise two or more of a gravitational force, a magnetic force, and another different attachment force.

3. The system as recited in claim 1, wherein one or both of the first and second first attachment interfaces of the handbag cover comprise magnetic forces.

4. The system as recited in claim 3, wherein the magnetic forces are provided by one or more magnets and one or more magnetic elements that are flush with one of the first and second base handbag attachment interfaces and the first and second handbag cover attachment interfaces.

5. The system as recited in claim 1, wherein the handbag cover is essentially collapsible.

6. The system as recited in claim 1, wherein the one or more fastener elements of the first and second base handbag attachment interfaces and the one or more fastener elements of the first and second handbag cover attachment interfaces are positioned so as to be hidden from view before attachment of the handbag cover to the base handbag.

7. The system as recited in claim 1, further comprising a releasable handle configured to be releasably secured to the base handbag.

8. The system as recited in claim 1, wherein:

the base handbag has two secondary base handbag attachment interfaces on opposing sides thereof;

the handbag cover has two secondary handbag cover attachment interfaces on opposing sides thereof, the two secondary handbag cover attachment interfaces being configured to align with the two secondary base handbag attachment interfaces when the handbag cover is disposed about the base handbag; and further comprising a strap selectively connectable to both the base handbag and the handbag cover via the two secondary base handbag attachment interfaces and the two secondary handbag cover attachment interfaces when the handbag cover is disposed about the base handbag.

9. The system as recited in claim 1, further comprising a plurality of releasable clips configured to secure one or more of a releasable handle and a releasable strap to one or more of the base handbag and the handbag cover.

10. The system as recited in claim 9, wherein at least one of the plurality of different attachment forces comprises a mechanical force provided by the plurality of releasable clips; and at least another of the plurality of different attachment forces comprises magnetic forces.

11. A method of customizing a soft handbag, comprising:

positioning a handbag cover about a base handbag, the base handbag having an interior and an exterior and first and second attachment interfaces on opposed side upper edges thereof;

folding a first attachment interface of the handbag cover along a crease to sandwich an upper first edge of the base handbag between upper and lower portions of the first attachment interface of the handbag cover, the crease in the first attachment interface connecting a plurality of fastener elements on opposing sides of the crease;

folding a second attachment interface of the handbag cover along a crease to sandwich an upper second edge of the base handbag between upper and lower portions of the second attachment interface of the handbag cover, the crease in the second attachment interface connecting a plurality of fastener elements on opposing sides of the crease;

securing the connected plurality of fastener elements in the first attachment interface to opposing sides of the upper first edge; and securing the connected plurality of fastener elements in the second attachment interface to opposing sides of the upper second edge.

12. The method as recited in claim 11, wherein folding the first attachment interface and the second attachment interface of the base handbag over the corresponding upper first or second edges of the base handbag further creates at least a gravitational attachment force that holds the handbag cover in position about the base handbag.

13. The method as recited in claim 11, wherein at least some of the plurality of fastener elements comprise magnets.

14. The method as recited in claim 11, further comprising positioning essentially the entire base handbag within the handbag cover thereby concealing at least a majority of the base handbag.

15. A customizable handbag system comprising:

a base handbag including a first attachment interface along a first edge and a second attachment interface along a second edge, wherein the first and second edges are separated by an opening for a main pouch in the base handbag; and a handbag cover configured to be positioned to at least partly conceal the base handbag, the handbag cover comprising at least a first attachment interface comprising one or more magnetic fastener elements on an upper portion and one or more magnetic fastener elements on a lower portion, the upper and lower portions being separated by a crease;

wherein, when positioned about the base handbag to at least partly conceal the base handbag:

the at least first attachment interface of the handbag cover is selectively foldable along the crease to sandwich the first edge of the base handbag between magnetic fastener elements on the upper and lower portions of the first attachment interface on the handbag cover, such that the one or more magnetic fastener elements in the upper and lower portions attach to opposing surfaces of the first edge; and a second attachment interface of the handbag cover is selectively attachable to the second attachment interface along the second edge of the base handbag.

16. The customizable handbag system as recited in claim 15, wherein:

the second attachment interface comprises one or more magnetic fastener elements on an upper portion and one or more magnetic fastener elements on a lower portion; and the upper and lower portions are separated by a crease.

17. The customizable handbag system as recited in claim 15, wherein:

the fastener elements of the second attachment interface comprises one or more of hook and loop, and snap fasteners; and the upper and lower portions are separated by a crease.

* * * * *